United States Patent [19]

Kroeger et al.

[11] Patent Number: 4,581,081

[45] Date of Patent: Apr. 8, 1986

[54] METALLIC GLASS COMPOSITION

[75] Inventors: Donald M. Kroeger, Knoxville, Tenn.; Carl C. Koch, Raleigh, N.C.

[73] Assignee: The United States of America as represented by the United States Department of Energy, Washington, D.C.

[21] Appl. No.: 650,464

[22] Filed: Sep. 14, 1984

[51] Int. Cl.[4] ..... C22C 38/32; C22C 19/00

[52] U.S. Cl. ..... 148/403; 75/123 E; 420/455

[58] Field of Search ..... 75/123 E, 123 B, 123 L, 75/123 D; 420/455; 148/403

[56] References Cited

U.S. PATENT DOCUMENTS 4,409,043 10/1983 Koon ..... 148/403

FOREIGN PATENT DOCUMENTS 113304 9/1980 Japan ..... 75/123 B
105454 8/1981 Japan ..... 148/403
WO81/00861 4/1981 PCT Int'l Appl. ..... 148/403

*Primary Examiner*—Christopher W. Brody
*Attorney, Agent, or Firm*—Katherine P. Lovingood; Stephen D. Hamel; Judson R. Hightower

[57] ABSTRACT

A metallic glass alloy that is either iron-based or nickel-based or based on a mixture of iron and nickel, containing lesser amounts of elements selected from the group boron, silicon carbon and phosphorous to which is added an amount of a ductility enhancing element selected from the group cerium, lanthanum, praseodymium and neodymium sufficient to increase ductility of the metallic glass upon annealing.

4 Claims, 1 Drawing Figure

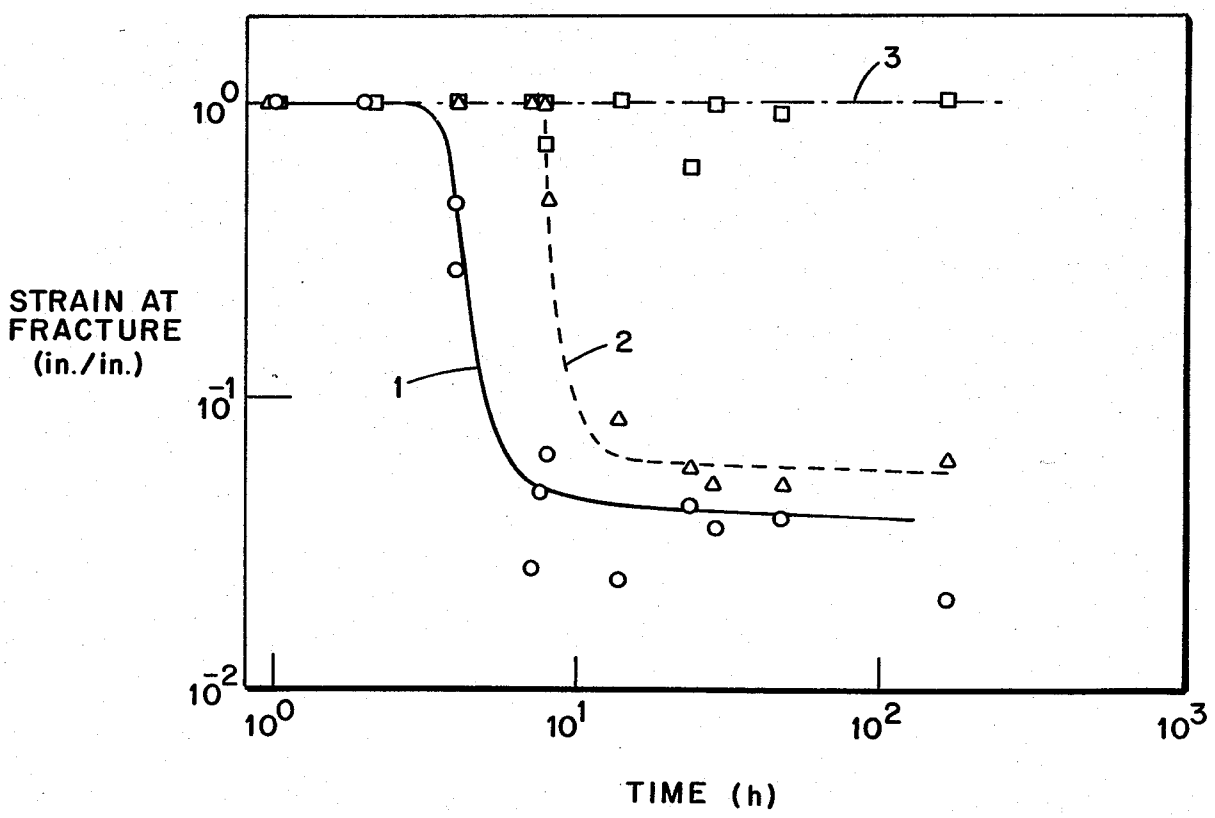
STRAIN AT FRACTURE (in./in.)
$10^0$
$10^{-1}$
$10^{-2}$
$10^0$
$10^1$
$10^2$
$10^3$
TIME (h)
1
2
3

METALLIC GLASS COMPOSITION

BACKGROUND OF THE INVENTION

Metallic glasses are known compositions of metals and metalloids that are amorphous, unlike most metal compositions which have a crystalline structure. This amorphous characteristic gives them the name "glass".

The iron-based metallic glasses are useful in magnetic cores of transformers, motors, and other similar articles of manufacture due to their ease of magnetization and low energy loss. Although the excellent magnetic properties of these compositions can be further enhanced by annealing, annealing causes embrittlement, whereas they are usually ductile in their as-quenched condition. Therefore, a need existed to reduce or eliminate the embrittlement of these annealed glasses without affecting their excellent magnetic properties. The invention was prepared pursuant to a contract with the United States Department of Energy.

SUMMARY OF THE INVENTION

In view of the above-mentioned need it is an object of this invention to provide an improved metallic glass.

Another object of this invention is to provide a metallic glass composition that does not embrittle upon annealing.

It is a further object of this invention to provide a metallic glass composition that magnetizes easily.

It is another object of this invention to provide a metallic glass composition that has low energy losses.

Additional objects, advantages and novel features of the invention will be set forth in part in the description which follows, and in part will become apparent to those skilled in the art upon examination of the following or may be learned by practice of the invention. The objects and advantages of the invention may be realized and attained by the composition set forth in the appended claims.

To achieve the foregoing and other objects and in accordance with the purpose of the present invention as embodied and broadly described, this invention is a metallic glass composition which remains ductile after annealing. It may be iron-based, nickel-based or based on a mixture of iron and nickel and, in addition, contains some or all of the metalloids boron, silicon, carbon and phosphorous. To these basic components an amount of one or more of the rare earths cerium, lanthanum, praseodymium and neodymium is added sufficient to reduce the embrittlement of the metallic glass upon annealing. Preferably, the amount of rare earth used should be less than 500 atomic parts per million of the composition as initially blended and the optimum amount is in the area of 100 atomic parts per million.

Annealing of metallic glasses improves their magnetic properties, makes them easier to magnetize and also reduces energy losses during their subsequent use in electric motors, etc. Heretofore, annealing also had an undesirable side effect in that it also caused embrittlement of the metallic glass. The advantage of adding small amounts of the rare earths as described herein is the reduction or elimination of embrittlement previously associated with annealing without affecting the excellent magnetic properties of the compositions.

BRIEF DESCRIPTION OF THE DRAWING

The drawing is a graph showing strain-at-fracture versus time comparing metallic glass compositions with and without the addition of a rare earth metal upon annealing at 300° C.

DETAILED DESCRIPTION OF THE PREFERRED EMBODIMENT OF THE INVENTION

This invention relates to compositions of metallic glasses with improved ductility after annealing. The basic metallic glass can be iron-based, nickel-based or based on a mixture of iron and nickel with some or all of the metalloids boron, silicon, carbon and phosphorous present in lesser amounts. To this basic metallic glass composition is added very small amounts of a ductility enhancing element selected from the group cerium, lanthanum, praseodymium, and neodymium. The addition of one or more of these ductility enhancing elements constitutes the invention resulting in markedly improved ductility in the annealed metallic glasses.

The metallic glasses are prepared by melting the pure materials in desired proportions with the melted ingots being turned several times to promote homogeneity. The resulting ingot is subsequently melted and spin cast by ejecting the melted alloy onto a spinning metal wheel to form an amorphous metallic glass ribbon on the surface of the wheel.

To investigate the mechanism of annealing embrittlement, Auger spectra were taken of embrittled, melt-spun ribbons of $Fe_{80}B_{16}Si_2C_2$ to compare the fracture surface with that of the bulk. It was found that the composition at the fracture surface differed from the composition of the bulk. There was not only evidence of increased presence of oxygen at the fracture surface as compared with the bulk, but there was also an indication of an inhomogeneous presence of the constituents of the metallic glass at the fracture surface. This inhomogeneity was absent in regions adjacent to the fracture surface. These differences were small but perhaps significant.

EXAMPLE

Ribbons of the metallic glass composition $Fe_{80}B_{16}Si_2C_2$ were prepared by melt spinning. Three samples were prepared; one with no cerium, one with 100 atomic parts per million cerium and one with 500 atomic parts per million cerium in the initial melt. Although the amounts of cerium were known when initially melted, the proportions actually in the finished ribbon may differ from the initial proportions due to slag formation and have not been determined with accuracy.

Bend ductility was measured by a simple bend test wherein the resulting ribbons were bent in a semi-circular loop between plates of a micrometer. The tensile strain at the outer surface of the ribbon is given by $\epsilon = t/(d-t)$, where d is the separation of the plates and t is the ribbon thickness. The fracture strain, $\epsilon_f$, is defined as the strain at which catastrophic fracture occurs. If a specimen can be bent back upon itself then $\epsilon = 1$ and it is considered ductile.

A comparison of the dependence of fracture strain on annealing time at 300° C. for the three different ribbons, differing only in the amount of cerium, is shown in the drawing. The ribbon prepared with no cerium (curve 1) begins to embrittle ($\epsilon_f < 1$) after about three hours at 300° C. and strain at fracture rapidly decreases to about 0.04 to 0.05 after seven hours. The ribbon prepared with 500 atomic parts per million cerium (curve 2) begins to embrittle after about eight hours at 300° C. The ribbon prepared with 100 atomic parts per million cerium (curve 3) remains fully ductile after 167 hours at 300° C. The small presence of cerium had no effect on the magnetic properties of the annealed material.

There was an unusual development during ductility testing of the ribbons. When testing for ductility, the side of the ribbon next to the wheel during melt spinning was usually on the outside of the bend during testing. For the ribbons prepared with no cerium and with 500 atomic parts per million cerium there was symmetry in bend ductility regardless of whether the wheel side of the ribbon was on the outside or the inside during the ductility test. However, there was an unexpected asymmetry in bend ductility for the ribbon prepared with 100 atomic parts per million cerium. Although the ribbon showed markedly improved ductility from the cerium-free ribbon when the wheel side was on the outside, when tested with the wheel side of the ribbon on the inside no improvement was noted. This is not yet understood and does not negate the findings that addition of cerium to this metallic glass decreased its tendency to embrittle upon annealing.

Addition of rare earths to crystalline iron- and nickel-based alloys is known to reduce the concentrations of embrittling agents oxygen and sulfur at grain boundaries. However, it is surprising that adding these elements to metallic glasses reduces embrittlement because the glasses, unlike their crystalline counterparts, are amorphous and, therefore have no grain boundaries. It is expected that other metallic glasses, nickel-based as well as iron-based, would show improved ductility on annealing when treated with small amounts of cerium. It is also expected that in addition to cerium other rare earths, lanthanum, praseodymium and neodymium would be effective in improving ductility in annealed metallic glasses. Such improved metallic glasses could be of significant use in manufacture of magnetic cores in transformers and motors due to their improved magnetic properties.

We claim:

1. A metallic glass composition consisting of:

a basic metallic glass composition consisting of a major constituent selected from the group iron, nickel and mixtures thereof and a lesser constituent selected from the group boron, silicon, carbon, phosphorus and mixtures thereof; and an amount of less than 500 atomic parts per million of a ducility enhancing element selected from the group cerium, lanthanum, praseodymium, neodymium, and mixtures thereof sufficient to increase the ductility of said metallic glass composition upon annealing.

2. The metallic glass composition of claim 1 wherein said ductility enhancing element is cerium.

3. The metallic glass composition of claim 2 wherein said basic metallic glass composition consists of a major constituent of iron and a lesser constituent selected from the group boron, silicon, carbon and mixtures thereof.

4. The metallic glass composition of claim 3 wherein said basic metallic glass composition is $Fe_{80}B_{16}Si_2C_2$.

* * * * *